US007788878B1

(12) United States Patent
diGirolamo et al.

(10) Patent No.: US 7,788,878 B1
(45) Date of Patent: Sep. 7, 2010

(54) DEVICE AND METHOD FOR BRACING A WALL STRUCTURE

(75) Inventors: Edward R. diGirolamo, Raleigh, NC (US); James E. Herrmann, Raleigh, NC (US); Nabil Abdel-Rahman, Raleigh, NC (US); John Parks Newby, Raleigh, NC (US)

(73) Assignee: The Steel Network, Inc., Raleigh, NC (US)

( * ) Notice: Subject to any disclaimer, the term of this patent is extended or adjusted under 35 U.S.C. 154(b) by 207 days.

(21) Appl. No.: 12/062,017

(22) Filed: Apr. 3, 2008

(51) Int. Cl.
*E04B 1/24* (2006.01)
*E04B 1/08* (2006.01)
*E04B 2/06* (2006.01)

(52) U.S. Cl. ..... 52/745.19; 52/657; 52/656.1; 52/146; 52/693; 52/695; 29/897.3

(58) Field of Classification Search ..... 52/657, 52/656.1, 800.12, 146, 167.3, 693, 695, 745.19; 29/897, 897.1, 897.3
See application file for complete search history.

(56) References Cited

U.S. PATENT DOCUMENTS 2,856,646 A * 10/1958 Latimer et al. ..... 52/223.6
3,608,259 A * 9/1971 Iwens ..... 52/263
D227,086 S * 6/1973 Johnson ..... D25/61
4,040,232 A * 8/1977 Snow et al. ..... 248/351
4,267,682 A * 5/1981 Fowler et al. ..... 52/657
4,441,289 A * 4/1984 Ikuo et al. ..... 52/167.1
4,563,851 A * 1/1986 Long ..... 52/656.1
4,706,436 A * 11/1987 Mabey et al. ..... 52/645
4,920,725 A * 5/1990 Gore ..... 52/702
RE34,103 E * 10/1992 Mabey et al. ..... 52/645
5,657,606 A * 8/1997 Ressel et al. ..... 52/690
5,937,607 A * 8/1999 Li ..... 52/656.1
6,148,583 A * 11/2000 Hardy ..... 52/693
6,185,898 B1 * 2/2001 Pratt ..... 52/657
6,192,637 B1 * 2/2001 Boilen et al. ..... 52/167.3
6,240,695 B1 * 6/2001 Karalic et al. ..... 52/690
6,250,041 B1 * 6/2001 Seccombe ..... 52/712
6,308,469 B1 * 10/2001 Leung ..... 52/167.3
6,389,778 B1 * 5/2002 Strange ..... 52/745.19
6,493,998 B1 * 12/2002 Pryor ..... 52/92.2
6,892,504 B1 * 5/2005 diGirolamo et al. ..... 52/657
6,920,724 B1 * 7/2005 Hundley ..... 52/167.3
6,941,718 B1 * 9/2005 diGirolamo et al. ..... 52/695
7,140,155 B1 * 11/2006 Nasimov ..... 52/236.8
7,299,593 B1 * 11/2007 diGirolamo et al. ..... 52/241

(Continued)

*Primary Examiner*—Brian E Glessner
*Assistant Examiner*—Jason Holloway
(74) *Attorney, Agent, or Firm*—Coats & Bennett, P.L.L.C.

(57) ABSTRACT

A boot assembly for securing a bracing strap to a wall in a light steel frame building. The boot assembly includes an elongated channel-shaped strap connector and a stud connector. The stud connector is adapted such that a stud may be connected thereto. The strap connector includes a seat for receiving a base of the stud connector and a pair of stops. One or more stops is disposed on each of two end portions of the strap connector. Each stop includes a stop surface to abut a portion of the base and to prevent or limit fore-and-aft movement of the base relative to the strap connector. The strap connector is adapted to be secured with the stud connector and a track, included in the wall, to an underlying support. The strap connector includes a flange adapted such that an end portion of a bracing strap can be connected thereto.

6 Claims, 4 Drawing Sheets

U.S. PATENT DOCUMENTS 7,299,596 B2 * 11/2007 Hildreth ..... 52/695
2005/0229509 A1 * 10/2005 Majlessi ..... 52/167.3
2007/0289230 A1 * 12/2007 Schroeder et al. ..... 52/149
2009/0211194 A1 * 8/2009 Fyfe et al. ..... 52/657

* cited by examiner

DEVICE AND METHOD FOR BRACING A WALL STRUCTURE

FIELD OF THE INVENTION

The present invention relates to light steel frame buildings and bracing stud walls thereof.

BACKGROUND

Bracing of stud wall in light steel frame buildings is often accomplished by securing diagonal bracing straps to the walls. Such bracing straps resist shear deformation of stud walls. Shear deformation of walls may be caused by loads on the building, such as from wind, that tend to distort and damage the building. The efficacy of bracing straps in resisting wall shear is at least in part dependent upon the integrity of the connection of ends of the bracing straps to the wall. In some applications, forces tending to shear the walls are of sufficient magnitude to cause unacceptable fore-and-aft movement of the ends of bracing straps and the portions of the walls to which they are connected.

SUMMARY OF THE INVENTION

The present invention provides a boot assembly for securing light metal bracing to a wall structure. A typical structure includes a plurality of spaced apart studs received in a track disposed on an underlying support. The boot assembly includes a strap connector comprising a channel having a web and a pair of flanges extending there from. The strap connector nests in the track and is secured with the track to the underlying support structure. The assembly also includes a stud bracket comprising a base and a tab extending generally normal from the base. The stud bracket is adapted to nest in the strap connector and to be secured with the strap connector and the track to the underlying support. The tab of the stud bracket connects to a stud. The strap connector includes at least one pair of spaced apart stops disposed adjacent the stud bracket for engaging the bracket and preventing fore-and-aft movement of the bracket in the strap connector.

In one embodiment, the present invention provides a device for securing a bracing strap to a light metal stud wall. The device comprises a pair of flanges and an elongated web, the flanges extending generally normal to the web. The web includes opposite end portions wherein at least one projection is disposed on each end portion and projects there from.

The present invention also provides a method of forming a strap connector for securing a bracing strap to a light metal stud wall. The method includes forming a strap connector in a channel configuration for nesting in the track. The method further comprises the strap connector including an elongated web and a pair of flanges extending generally normal to the web. The method includes providing a pair of projections, one projection on each end portion of the strap connector and projecting there from for engaging a stud connector and preventing sliding movement of the column connector.

The present invention further provides a method of securing bracing to a light metal framed stud wall. The method includes nesting an elongated strap connector in a track disposed on an underlying support structure and extending a portion of an anchor bolt through an opening in the track and an opening in the strap connector. The method also includes securing a stud or a tab of a stud bracket or stud connector wherein the stud bracket includes a base that is generally normal to the tab and secured there to. This connection resists uplift condition of the stud column. Extending the portion of the anchor bolt through an opening in the base of the stud bracket and securing a fastener to the anchor bolt is further included in the method. Further comprised in the method is positioning the base of the stud bracket adjacent the web of the strap connector in a seat disposed between a pair of stops, one stop disposed on each end portion of the strap connector to prevent fore-and aft movement of the stud bracket. The method also includes positioning an end plate of a bracing strap adjacent a flange and connecting the end plate to the flange.

Other objects and advantages of the present invention will become apparent and obvious from a study of the following description and the accompanying drawings which are merely illustrative of such invention

DESCRIPTION OF THE INVENTION

Figure 1:
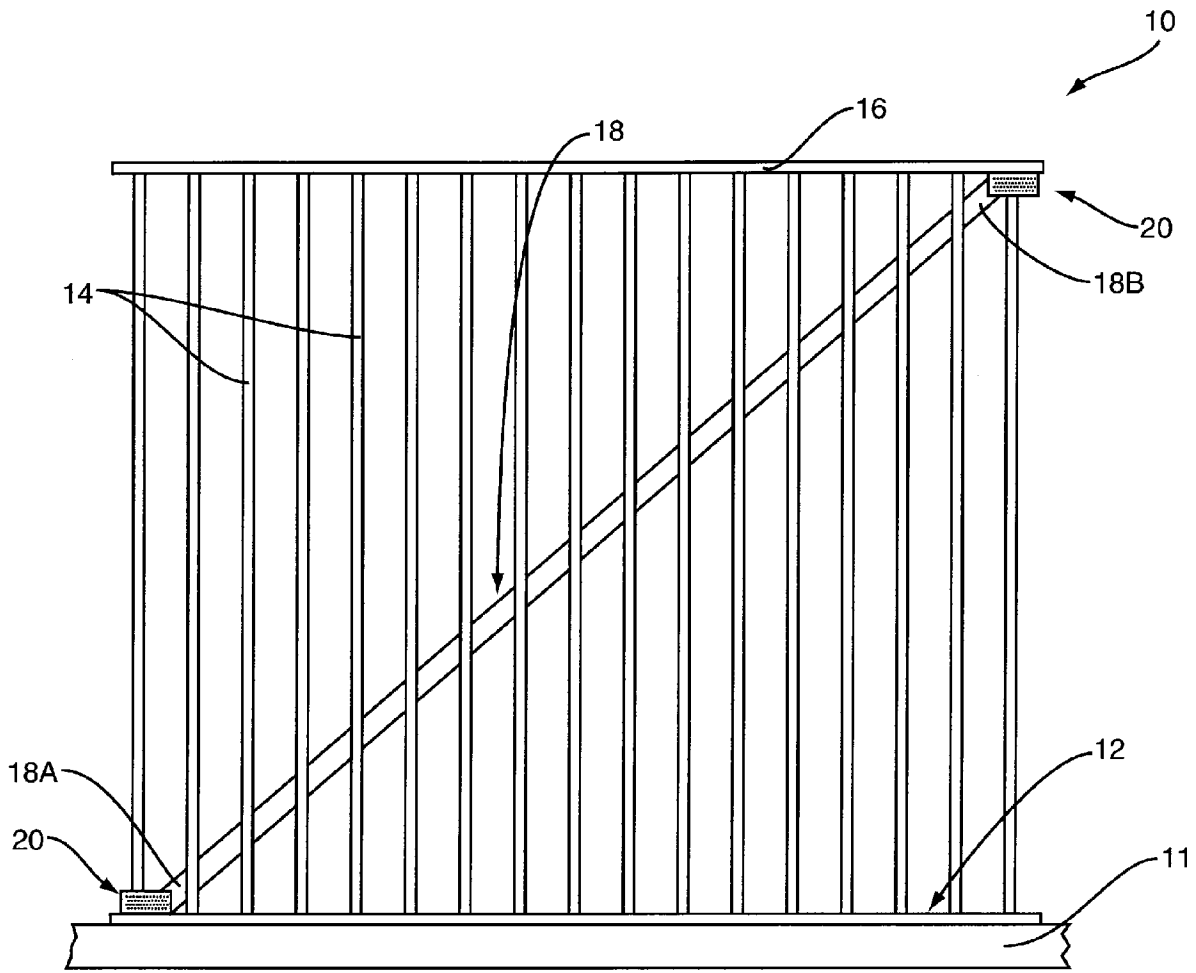
FIG. 1 is a front elevation of a stud wall.

With further reference to the drawings, the present invention relates to a device for use in bracing a stud wall 10 in a light steel or metal frame building. The device includes a boot assembly 20 for facilitating connection of a bracing strap 18 to stud wall 10 in order to prevent or limit shear, or angular, deformation of the wall. In particular, as shown in FIG. 1, stud wall 10 includes a bottom track 12 resting on an underlying support 11 and a plurality of generally vertical, spaced apart studs 14 with lower ends thereof received in the bottom track 12. Upper ends of stud column 14 are similarly received within a top track 16. Top track 16 may be connected to an overlying structure (not shown).

Bracing strap 18 is disposed generally diagonally on wall 10 and is secured to the wall at opposite ends of the strap. Boot assembly 20 is adapted to connect to a lower end portion 18A of strap 18. Boot assembly 20 is further adapted to be secured to stud column 14, to track 12, and to underlying structure 11. Another boot assembly 20 is also utilized to secure an upper end portion 18B of bracing strap 18 to wall 10.

The description below focuses on boot assembly 20 deployed at a lower portion of wall 10 to secure bracing strap 18 thereto, with the strap extending generally in a diagonal direction towards an upper portion of the wall. It is appreciated, however, that the same description will generally apply to deploying boot assembly 20 to secure bracing strap 18 on an upper portion of wall 10. Likewise, the description will generally apply to utilizing boot assembly 20 in any stud wall-type structure to secure bracing strap 18 thereto and to provide shear resistance to the structure. Accordingly, uses of the terms above, top, over, overlying, below, bottom, under, underlying, and other directional apposition terms are merely terms of reference for the purpose of clearly describing exemplary embodiments. Uses of such terms herein are not intended to limit the scope of the invention.

Figure 2:
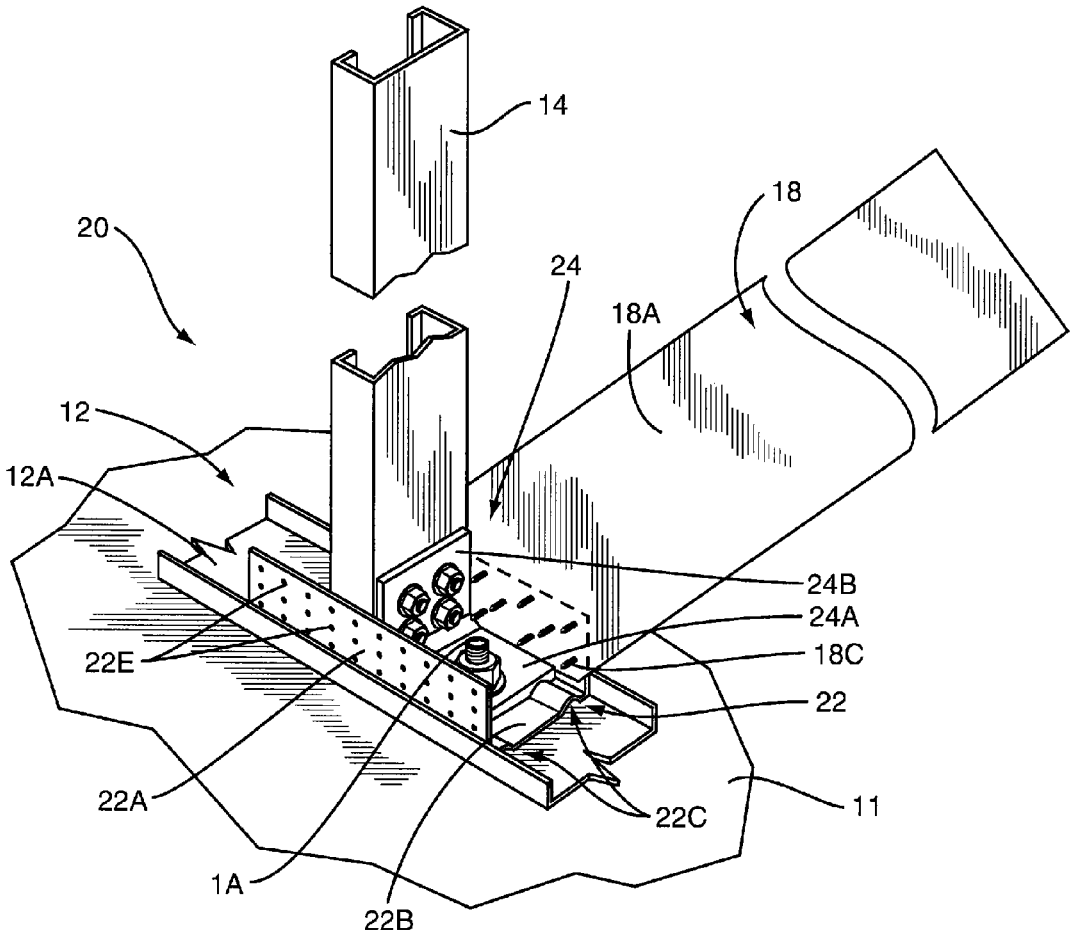
FIG. 2 is a fragmentary perspective of a portion of a stud wall.
Figure 3A:
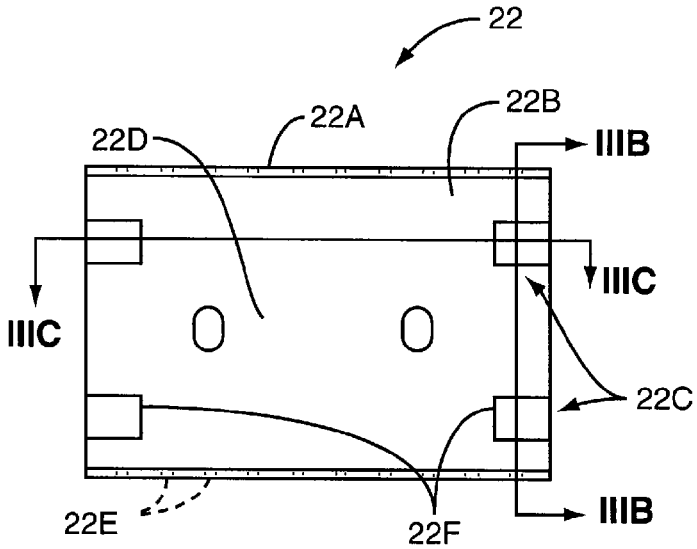
FIG. 3A is a plan view of the strap connector.
Figure 3B:
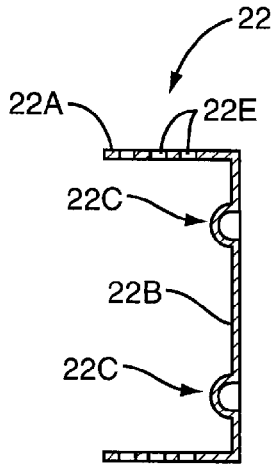
FIG. 3B is an end sectional view of the strap connector.
Figure 3C:
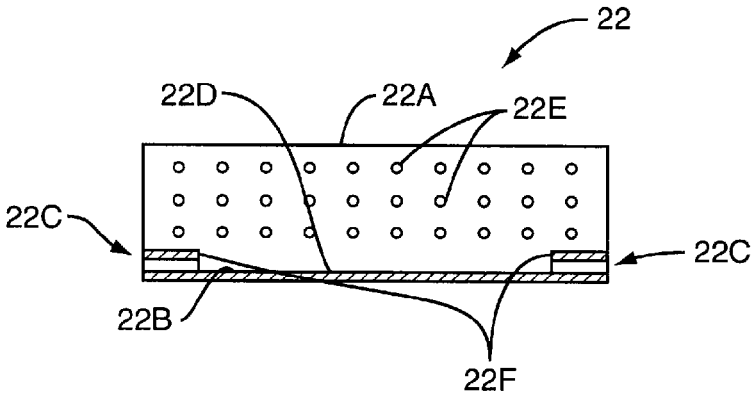
FIG. 3C is a side sectional view of the strap connector.
Figure 4:
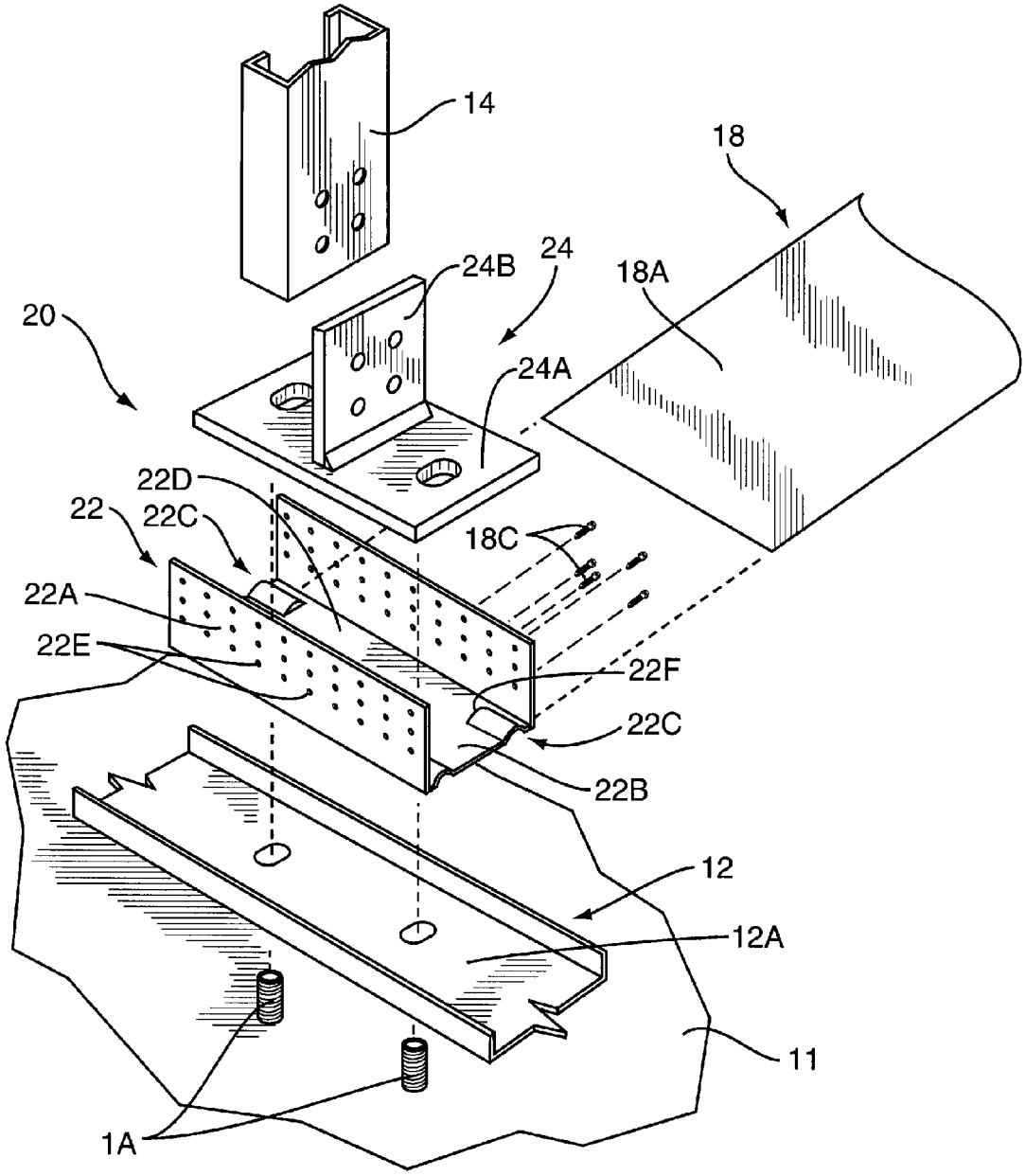
FIG. 4 is an exploded view of a portion of a stud wall.

Turning now to a detailed description of boot assembly 20 and its utilization, and referring particularly to FIGS. 2-4, the boot assembly includes an elongated channel-shaped strap connector 22 and a stud bracket or connector 24 adapted to nest in the strap connector. Strap connector 22 is, in one embodiment, formed of sheet metal or steel, by employing common sheet metal forming operations known to those of ordinary skill in the art of sheet metal fabrication. These operations include bending, cutting, drilling, drawing, and punching, among others. In describing the formation of strap connector 22, the description of uses of particular sheet metal forming operations is merely for clarity in describing exemplary formation methods. Likewise, certain methods and devices for fastening various sheet metal components in forming boot assembly 20 and deploying the assembly in wall 10 are discussed. It is understood that these fastening methods and devices are merely exemplary and that the invention is not limited to the use of such fastening methods and devices. For convenience and clarity, the structure of strap connector 22, and the formation and deployment thereof will be described together.

Strap connector 22 includes a pair of flanges 22A and is formed by bending an appropriately sized piece of sheet metal. Flanges 22A extend generally normal to a web 22B of strap connector 22. Each flange 22A includes a plurality of openings or guide holes 22E, punched or drilled in the flange for receiving fasteners or screws 18C. One or more elongated openings are punched or provided in web 22B to facilitate extending anchor bolts 1A, for example, there through. The elongated openings allow easier installation of the anchor bolts 1A.

In one embodiment, a pair of stops 22C is disposed on strap connector 22 such that one stop is disposed on one end portion and the other stop is disposed on the opposite end portion of the strap connector. In one embodiment, two pairs of stops 22C are disposed on strap connector 22. One of the stops 22C of each pair is disposed on each end portion of strap connector 22. As seen in the drawings, in the embodiment illustrated therein, there is provided two stops 22C on each end of the strap connector 22. In one embodiment, stops 22C are formed in web 22B of strap connector 22.

Turning now to the structure and formation of stops 22C, in one embodiment at least one of the stops 22C comprises a projection extending from an inner surface of channel-shaped strap connector 22. In one embodiment, stop 22C comprises a portion of web 22B that is bent such that the portion extends away from the web and between flanges 22A. Stop 22C may be formed by cutting web 22B and drawing or deforming a portion of the web adjacent the cut the portion away from the web and between flanges 22A. In one embodiment, stop 22C is formed by cutting a slit in an end portion of web 22B and drawing a portion of the web to form an arcuate projection above the web as illustrated in FIG. 3B. A face 22F of each projection or stop 22C forms a stop surface for receiving and having abutted thereto a portion of base 24A of stud bracket 24. A planar seat 22D is defined on web 22B, being generally between opposing faces or stop surfaces 22F of stops 22C. Seat 22D is planar and adapted to receive base 24A of stud bracket 24.

Stud bracket 24 is adapted to nest within strap connector 22 such that base 24A of the stud bracket is seated against web 22B between opposed stops 22C. Ends of base 24A abut stop surfaces or faces 22F.

One of the studs 14 is secured to a tab 24B. When boot assembly 20 is deployed, web 22B of strap connector 22 is sandwiched between web 12A of track 12 and base 24A. Stud bracket 24, strap connector 22, and track 12 are together secured, in one embodiment, to a slab or underlying support structure 11 with anchor bolts 1A and suitable nuts and washers. Thus secured together and to underlying support 11, stud bracket 24 and strap connector 22 are substantially prevented from fore-and-aft movement by anchor bolts 1A and by friction at the interfaces of certain components.

Bracing strap 18 is connected to one of the flanges 22A. In one embodiment, to connect bracing strap 18 to strap connector 22, end portion 18A of the strap is extended adjacent flange 22A and partially between stud 14 and the flange. End portion 18A and flange 22A are secured together by inserting fasteners or screws 18C into openings or guide holes 22E in flange 22A (FIG. 2). Screws 18C may be, for example, self drilling and tapping sheet metal screws. Fasteners or screws 18C may be guided through guide holes 22E, drilled and threaded into and through end portion 18A, and tightened to secure brace 18 to flange 22A. A sufficient number of guide holes 22E are provided to permit an adequate number of screws 18C to be deployed to secure bracing strap 18 to strap connector 22. It is noted that bracing strap 18 may be secured on either side of wall 10, or on both sides.

An exemplary boot assembly 20 includes a strap connector 22 formed of 12 gage sheet metal and having a length of about 8 inches. Flanges 22A extend about 2 inches above an approximately 4 inch wide web 22B. The width of arcuate stops 22C measured between points where the arcuate portion intersects web 22B is about 1 inch. The length of stop 22C, measured from face 22F to the opposite end of the stop is about ¾". Openings or guide holes 22E are each about ⅛ inch in diameter and the openings are spaced approximately ¾ inch apart. A typical deployment would entail using about eight or ten number 12 self drilling and tapping sheet metal screws spaced as illustrated in FIG. 2 to secure strap 18 to strap connector 22. The dimensions and sizes given herein are merely for example and relate to a particular wall structure utilizing nominal 4 inch studs 14.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A method of securing bracing to a light metal framed stud wall, including:

a. nesting an elongated strap connector in a track disposed on an underlying support structure and extending a portion of an anchor bolt through an opening in the track and an opening in the strap connector;

b. securing a stud to a tab of a stud bracket wherein the stud bracket includes a base that is generally normal to the tab and secured there to;

c. securing the strap connector, the stud bracket and the track to the underlying structure;

d. positioning the base of the stud bracket adjacent a web of the strap connector in a seat formed between a pair of stops formed in the strap connector, one stop disposed on each of two end portions of the strap connector to prevent fore-and-aft movement of the stud bracket;

e. wherein positioning the base of the stud bracket adjacent the web of the strap connector includes constraining the movement of the stud bracket within the strap connector by placing the stud bracket between opposing faces of the pair of stops such that the stud is prevented from moving horizontally back and forth in the plane of the stud wall; and f. positioning an end portion of a bracing strap adjacent a flange of the strap connector and connecting the end portion to the flange.

2. The method of claim 1 wherein positioning the base of the stud bracket between the pair of stops includes abutting opposite ends of the base against stop surfaces formed on the stops.

3. The method of claim 1 including securing two strap connectors to a light metal framed stud wall where the two strap connectors are diagonally disposed with respect to each other.

4. The method of claim 3 including extending the bracing strap between the two strap connectors and connecting opposite ends of the bracing strap to flanges of the two strap connectors.

5. The method of claim 1 including projecting the pair of stops upwardly out of the plane of the web of the strap connector such that the pair of stops are horizontally aligned, and wherein the base of the stud bracket includes a horizontal plate, and the method includes seating the horizontal plate of the stud bracket between the pair of stops that project upwardly from the web of the strap connector, and preventing the plate of the stud bracket from moving horizontally back and forth in the plane of the stud wall.

6. The method of claim 5 wherein the stops are formed in the web of the strap connector by cutting the web of the strap connector at a plurality of locations and deforming a portion of the web of the strap connector adjacent to where the web is cut, and wherein the deformed portions of the web form the stops.

* * * * *